United States Patent [19]

Koscik et al.

[11] 4,020,970

[45] May 3, 1977

[54] ROTATABLE CLOSURE DEVICE

[75] Inventors: Richard A. Koscik, Richton Park; George M. Rapata, Park Ridge, both of Ill.

[73] Assignee: Illinois Tool Works Inc., Chicago, Ill.

[22] Filed: Dec. 24, 1975

[21] Appl. No.: 644,013

[52] U.S. Cl. ..... 220/293; 220/295; 220/302

[51] Int. Cl.[2] ..... B65D 41/06

[58] Field of Search ..... 220/292, 293, 295, 298, 220/301, 302, 297, 304, 305

[56] References Cited

UNITED STATES PATENTS

| | | | |
|---|---|---|---|
| 2,908,417 | 10/1959 | Conner et al. | 220/301 X |
| 3,010,673 | 11/1961 | Marconi | 220/298 X |

*Primary Examiner*—William Price
*Assistant Examiner*—Steven M. Pollard
*Attorney, Agent, or Firm*—Jack R. Halvorsen; Robert W. Beart

[57] ABSTRACT

A one-piece plastic closure device for use in a filler hole, i.e. an oil filler cap or crankcase vent means, which seals the hole from the outside and can be applied with a fractional turn of the closure. The closure is adapted for use in a panel with an aperture having communicating lateral slots which telescopically accepts spring controlled retainer pads extending laterally from the closure body and that are moved to underlying relationship with the panel by rotation of the closure; the spring means acting on said retainer pads insuring continued sealing engagement of the closure with the panel.

15 Claims, 9 Drawing Figures

Fig. 1
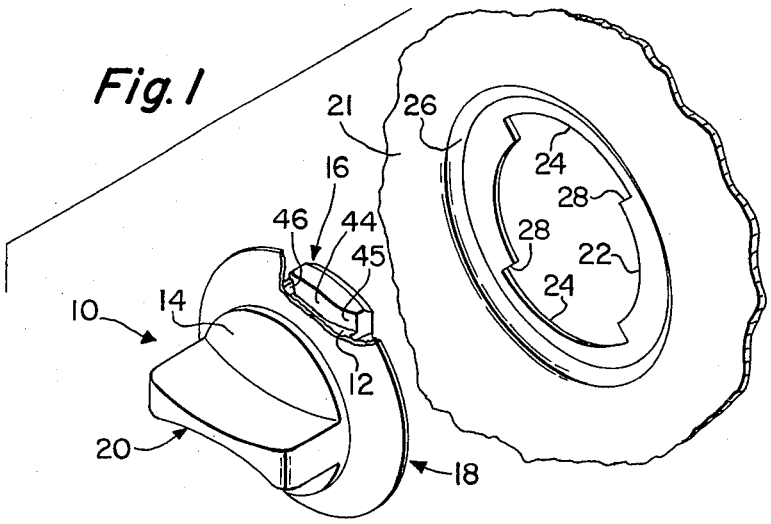
Fig. 2
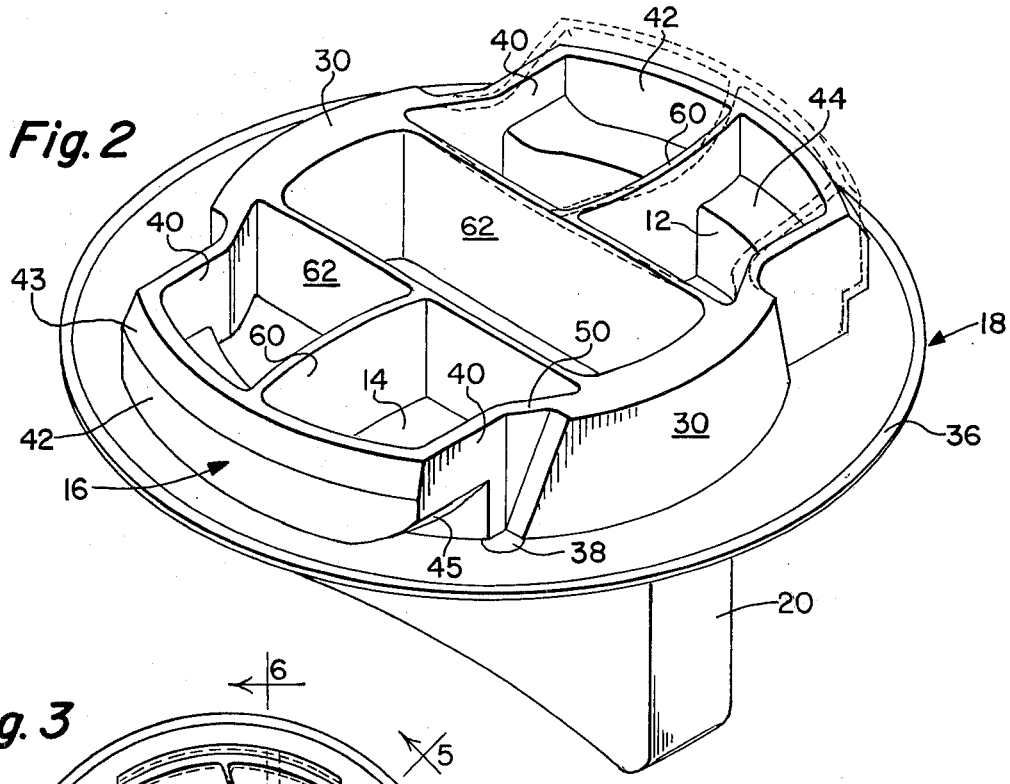
Fig. 3
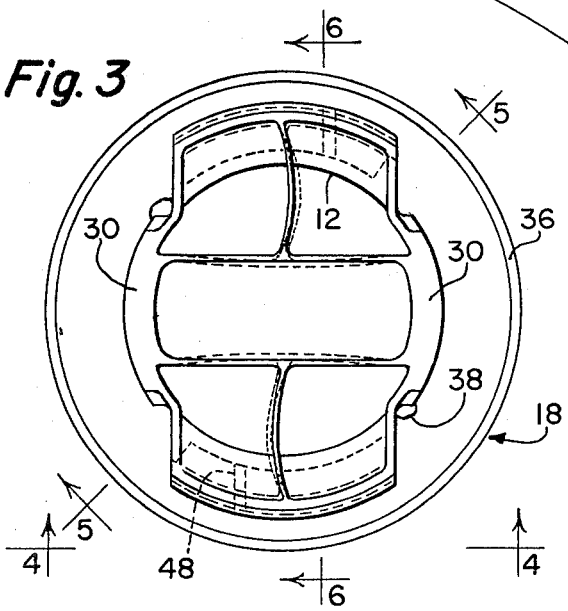
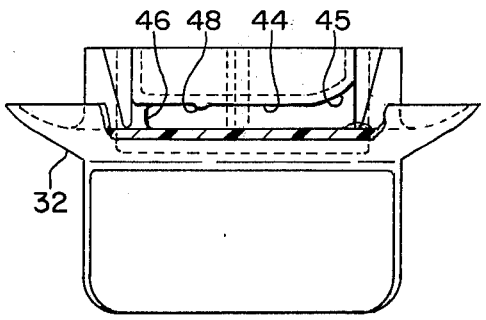
Fig. 4

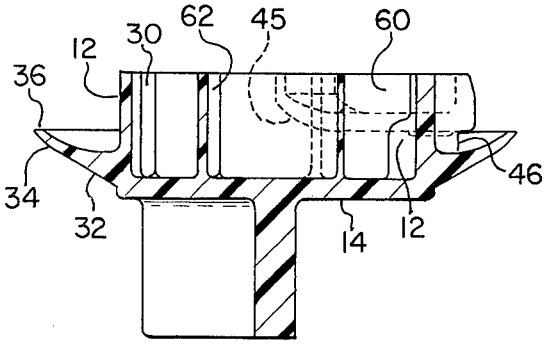
Fig. 5
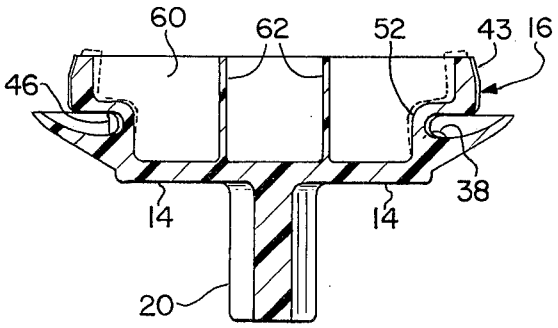
Fig. 6
Fig. 7
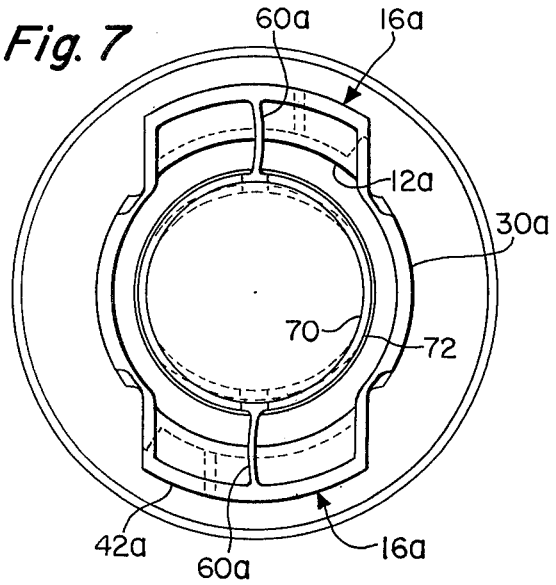
Fig. 8
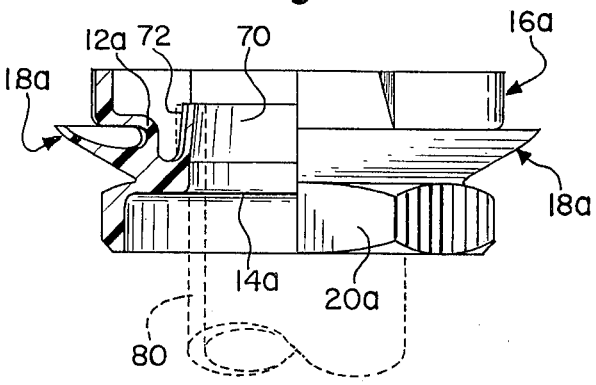
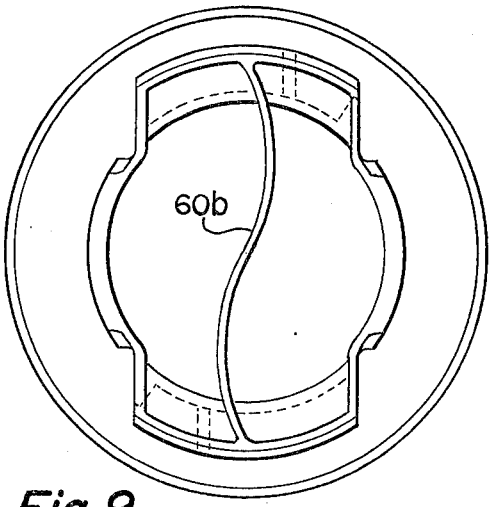
Fig. 9

ROTATABLE CLOSURE DEVICE

BACKGROUND OF THE INVENTION

In the field of automotive vehicles there are a plurality of access ports which communicate with various portions of the engine, for example, an oil filler hole and a crankcase vent wherein fumes from the crankcase are fed via a tubular member to the combustion system of the engine. A common device for closing such access ports is generally a rotatable cap consisting of several pieces, generally metallic, which often require special preparation of the aperture with which they are associated. Such devices will generally include a spring loaded gasket or similar means for purposes of sealing the closing member relative to the access port. Due to the metallic nature of this prior art, the closure means or caps become quite hot from the operating temperature of the engine and hence require insulating means to protect the hand of the mechanic servicing the engine. Failure of such devices often occurs due to the spring fatique in the locking means as well as failure of the gasket due to wear and repeated compression.

SUMMARY OF THE INVENTION

It is an object of the present invention to provide a one-piece plastic cap for closing access ports which is economical and reliable and which is acceptable in a simple stamped hole instead of the extruded and/or formed holes previously used.

A further object of the present invention is to provide integral built in spring means to provide a reactive force against the flexing retainer pads which are telescopicly associated with a simple keyhole aperture and upon rotation of the device are caused to underlie the panel carrying the aperture.

Still another object of the present invention is to provide spring means which rely upon the compressive forces which are best accepted by plastic materials and which will overcome any tendency in the retainer pads or the associated sealing flange carried by the head of the cap to "cold flow" under extended usage.

Other objects of the present invention will be apparent to those skilled in the art and all mechanical equivalents should be construed as being contemplated by the claims.

BRIEF DESCRIPTION OF THE DRAWINGS

FIG. 1 is an exploded perspective view, in partial section, of a preferred embodiment of the present invention along with an aperture of the type with which it is to be associated;

FIG. 2 is a perspective view of the retaining portion of the present invention;

FIG. 3 is a plan view of the present invention;

FIG. 4 is an end elevational view as viewed along line 4—4 of FIG. 3;

FIG. 5 is an elevational view in partial section taken along line 5—5 of FIG. 3;

FIG. 6 is a side elevational view in section taken along line 6—6 of FIG. 3;

FIG. 7 is a plan view of a second embodiment of the present invention;

FIG. 8 is an elevational view in partial section of the divice shown in FIG. 7 with a tubular member with which it is to be associated being shown in phantom; and FIG. 9 is a plan view of a third embodiment of the present invention.

DETAILED DESCRIPTION OF THE INVENTION

Referring now to the drawings wherein similar parts are identified by similar numerals; a closure device for access ports as contemplated by the present invention would include a cap 10 having a body 12 of generally cylindrical configuration; a head 14; one or more retainer pads 16; a sealing flange 18 extending generally laterally from the juncture of the body 12 and head 14; and rotation inducing means 20 carried on the head 14, in the present embodiment an axially extending tapered finger engaging means. The cap is adapted to be associated with an aperture 22 having one or more arcuate slots 24 communicating with aperture 22. Such an aperture can be in a flat panel or if the panel is crowned, such as that in a rocker cover in an automotive engine, the entire access port can be located in a flat bottom embossment 26, as shown in FIG. 1. The juncture of the slots 24 with the aperture 22 provide one or more stops or shoulders 28 for purposes best set forth hereinafter.

Referring now to FIGS. 2 through 5, the body 12 of cap 10 is generally cylindrical and is provided with opposed thickened wall portions 30 which extend circumferentially over a limited segment of the body and rise upwardly above the body in an axial direction. The outer wall of the thickened portion 30 falls on the same radius as the body 12 and is acceptable for rotation within the aperture 22.

In this embodiment, one end of the body is closed by an imperforate head 14. A sealing member 18 takes the form of a circumferentially continuous flange having a frusto-conical thickened portion 32 connected to the body adjacent the head and a progressively thinned domed portion 34 which terminates at a continuous sealing edge 36. Postioned adjacent the body 12 are one or more compressions pads 38 which extend axially from the concave inner surface of the flange 18 for purposes best set forth hereinafter.

Extending outwardly from the body 12 in spaced relation to the flange 18, are one or more retainer pads 16. These include side elements 40, and end element 42, a top bearing element 44 interconnecting the side elements 40 and the end element 42 with the bearing element 44 facing the concavity of flange 18. At one end of the bearing element 44 is a lead-in or cam surface 45 and at the opposite end of bearing element 44 a vertically disposed stop 46, which extends between the bearing element 44 and the flange 18. Intermediate the transverse extremities of bearing surface 44 is a protuberance or rib 48 which is crushable or shearable for take-up purposes. As can be best seen in FIG. 2, the end element 42 is preferably provided with a tapered portion 43 at its free end to assist in the introduction of the cap into the aperture 22 with its companion slots 24.

The side elements 40 of the retainer pad 16 are connected to the body 12 and the thickened wall portion 30 by a thinned tapered hinge or flexible portion 50. It will be noted that this flexible portion 50 is tapered in a diverging manner from the juncture of body 12 with flange 18 up to the free end. This tapering provides a uniform stress distribution as well as giving a substantially uniform flexing of the retainer pad 16 away from the flange 18 when the part is introduced into the aperture and rotated. As best seen in FIG. 6, the flexure or pivoting of pads 16 are generally along a line of juncture 52 with the side wall of body 12, in phantom.

To insure an aggressive flexure of retainer pads 16, it is necessary to provide secondary spring means which will reinforce and provide a reactive force against the flexure of retainer pads 16. In the present embodiment, this takes the form of a modified arcuate leaf compression spring 60 which is integrally connected to the interior surface of end element 42 at one of its ends while the opposite end is connected to and acts against a stiffening rib 62 extending transversely of the head and connected at opposite ends to the thickened wall portions 30. Both of the shallow arcuate springs 60 and stiffening ribs 62 are integrally connected along one edge to the head 14. In the present embodiment there are two stiffening ribs 62 extending transversely and connected to the thickened wall portions 30, and being under tension and substantially rigidly supported by the thickened wall portion 30, the ribs 62 provide a very stiff element against the reactive force of the spring 60. When the part is introduced into the aperture 22 and, in the present embodiment, its two companion slots 24, the retainer pads 16 are telescoped into the slots 24, with the body 12 and its thickened wall portion 30 being accepted within aperture 22, it is possible, by rotation in a clockwise manner, to cause the retainer pads to underlie the panel by first riding up the cam surface 45, causing a flexure, as shown in FIG. 2 in phantom, of the retainer pads 16. Rotation is continued until the stop 46 is brought to bear against the shoulder 28 forming one end of the slot 24. The flexure of the retainer pads 16 will cause a deflection of the spring 60, as shown in FIGS. 2 and 3, and simultaneously therewith will cause the flange 18 to flex axially to bring the sealing edge 36 into intimate relationship to the base of embossment 26. The compression pads 38 are provided opposite the juncture of the retainer pads 16 and the body 12 to insure a maximum point to which the flange 18 can be deflected and thereby not permit the flange 18 to go beyond its maximum stress limitations by bottoming the panel 21 against the pad 38. Additionally, the frusto-conical portion 32 will act as a rigid beam member to support the compression pad 38 in defining this maximum deflection situation.

The rib 48 carried by the top bearing element or surface 44 insures intimate contact where the thickness of material of panel 21, as defined by its aperture 22, is on the minimum tolerance side; the rib 48 serving as a take-up means to insure intimate engagement of the flange 18 and its sealing edge 36 with the panel. On the other hand, when the tolerance of panel thickness is on the high side, the rib 48 is capable of being crushed or distorted to give way and accommodate the additional thickness of the panel. In the latter instance, where flexure of the retainer pads 16 would be at a maximum, it is possible that the transverse stiffening ribs 62 could flex inwardly along their upper edge, as shown in exaggerated phantom in FIGS. 2 and 3.

It will be appreciated that other forms of spring means could be employed in place of the arcuate spring 60, such as by interconnecting the ends of the two similar and oppositely directed arcuate springs **60*b* (as shown in FIG. 9), or to provide a solid interconnection (not shown) between the thickened wall portion 30 instead of stiffening ribs 62. The stiffening ribs 62, of course, provide the desired function in the present embodiment as well as saving material over the solid central portion suggested, but not shown. It would also be possible to utilize a straight member instead of spring 60 and have the straight member act against a more resilient rib 62**. Further deviations will be apparent to those skilled in the art and should be construed as being contemplated.

Referring now to FIGS. 7 and 8 wherein a second embodiment of the present invention is shown, similar parts being identified by similar numberals with the addition of the suffix *a*, with this second embodiment being directed to a cap having a through bore for accepting a tube or hose 80 being acceptable through the through-bore 70. In this EMBODIMENT, there is included a body **12*a* having thickened wall portions 30*a*, a head 14*a* with a central bore 70 passing through the entire extend of body 12*a* and head 14*a*. An annular ring 72 is spaced radially inwardly from and axially disposed in the same direction as body 12*a*. Similar to the first embodiment, there is a sealing flange 18*a* and a pair of laterally extending retainer pads 16*a* plus a rotation inducing means 20*a*, in this embodiment the rotation inducing means taking the form of a hex-shaped wrenching face. Similarly, this second embodiment is provided with shallow arcuate compression springs 60*a* acting against the end element 42*a* of the retainer pads 16*a* and at its opposite end connected to the stiff resilient ring 72 which serves the same basic function as stiffening ribs 62** in the previous embodiment.

Thus, the present device is capable of being used to close an access port of the type shown in the first embodiment, but providing limited access thereto by means of a tube or hose 80, shown in phantom for clarity of illustration in FIG. 8, to thereby form a vent hole plug of the type commonly used in anti-pollution systems of automotive engines. The simplicity of the device, for example, the tapering of bore 70 to frictionally engage the tube or hose 80 without the assistance of clamps or other devices, readily assists the mechanic when servicing an engine in that the hose can be removed as the system is checked, or, if desired, that a complete seal be maintained, the hose or tube 80 can be cemented to the interior bore 70. If the arcuate spring **60*a* is replaced by a straight member, not shown, then the ring 72 would be deflected inwardly to an out-of-round condition which would serve as an additional securing means by impinging on hose 80**. By utilizing the same panel aperture and slot configuration of the first embodiment, the manufacturer can simplify his tooling by making it interchangeable for various parts of the engine. Thus, if parts are interchangeable, a plurality of apertures can be prepared in a specific engine block or cover and either a vented plug or a closing plug can be employed depending upon the particular model of car being produced. In certain applications, not shown, it may be desireable to provide rotation inducing means at the free end of the body rather than at the head end.

The present invention can be injection molded using normal procedures and standard thermo-plastic materials, such as nylon, or other materials which are compatible with the temperatures and fluids encountered in a particular environment.

Other variations than those referred to herein will be apparent to those skilled in the art.

I claim:

1. A one-piece plastic cap for use with an apertured panel having at least one slot communicating with said aperture, said cap including a body rotatably accepted within said aperture, a head portion having rotation inducing means, circumferentially continuous resilient sealing means extending laterally from adjacent one end of said body and having a diametral extent greater than said slotted aperture, at least one flexible retainer pad acceptable within said at least one slot and extending laterally from said body in predetermined spaced relation to said sealing means, and capable of resilient flexure to accommodate said panel between said at least one pad and said sealing means when said cap is rotated to cause said pad to underlie said panel, and transversely disposed resilient means for controlling the flexure in said pads.

2. A cap of the type claimed in claim 1 wherein said cap is adapted for use in an aperture which includes a plurality of slots and said cap includes retaining pads equal in number to said slots.

3. A cap of the type claimed in claim 1 wherein said sealing means includes a flange tapered from its juncture adjacent one end of said body and terminating in a sealing edge facing the other end of said body.

4. A cap of the type claimed in claim 3 wherein said flange includes a frusto-conical tapered thick portion at its juncture with said body and a domed tapered thinned portion about its outer periphery.

5. A cap of the type claimed in claim 4 wherein said frusto-conical portion is joined with said domed portion by a reversed radius.

6. A cap of the type claimed in claim 1 wherein said body includes a generally circumferentially disposed wall which is open at least at one end thereof, said retainer pads including side elements connected to said body wall, an end element and a top bearing element facing said sealing means in spaced relation said means for controlling flexure in said pads including central means disposed within said body wall reactively supporting stiffly resilient spring means acting against flexure of said pads.

7. A cap of the type claimed in claim 6 wherein said spring means is an arcuate leaf compression spring.

8. A cap of the type claimed in claim 6 wherein said central means includes at least one transverse stiffening rib extending between opposite sides of said body wall and against which said spring means reacts.

9. A cap of the type claimed in claim 7 wherein said central means includes one transversely extending stiffly resilient rib extending between opposite reinforced sides of said body wall for each retaining pad and reactively supporting said spring means acting on an individual pad.

10. A cap of the type claimed in claim 9 wherein said central means includes two generally parallel but spaced ribs and two retainer pads extending in opposite directions.

11. A cap of the type claimed in claim 6 wherein said central means includes an annular ring co-axial with said body and connected to said head, said head having a central bore communicating through said ring, said ring reactively supporting said spring means acting on each pad.

12. A cap of the type claimed in claim 6 wherein said side elements of each said retainer pad having hinge-like means connected to said body wall to permit pivoting of said retainer pad substantially along a line falling at the juncture of said bearing element and said wall.

13. A cap of the type claimed in claim 11 wherein said hinge-like means includes a tapered thinned connection between said side elements and said body wall, said connections having an increased width in a direction away from the retainer pad pivot line to thereby provide a substantially uniform stress during flexure thereof.

14. A cap of the type claimed in claim 6 wherein said head closes one end of said body wall and carries rotation inducing means thereon.

15. A cap of the type claimed in claim 6 wherein said head is provided with a through bore communicating with said open ended body and carries rotation inducing means thereon.

* * * * *